United States Patent [19]

Wilken

[11] 4,097,631

[45] Jun. 27, 1978

[54] SURFACE COVERING WITH INTERWOVEN FABRIC STRIPS

[76] Inventor: Judy Wilken, 15143 Kennedy Rd., Los Gatos, Calif. 95030

[21] Appl. No.: 799,890

[22] Filed: May 23, 1977

[51] Int. Cl.[2] ..... B32B 3/00; B32B 7/14

[52] U.S. Cl. ..... 428/114; 428/196; 428/198; 428/226; 428/236; 428/257

[58] Field of Search ..... 428/114, 198, 196, 226, 428/236, 257

[56] References Cited

U.S. PATENT DOCUMENTS

| | | | |
|---|---|---|---|
| 552,840 | 1/1896 | Johnson | 428/196 |
| 1,227,520 | 5/1917 | Angier | 428/236 |
| 1,501,156 | 7/1924 | Wilson | 428/236 |
| 1,983,617 | 12/1934 | Ladon | 428/226 |
| 2,260,052 | 10/1941 | Passavant | 428/226 |
| 2,573,773 | 11/1961 | Rowe | 428/236 |
| 2,757,436 | 8/1956 | Michall | 428/226 |
| 3,445,055 | 5/1969 | Fort et al. | 428/226 |
| 3,567,565 | 3/1971 | Jones et al. | 428/226 |
| 3,949,111 | 4/1976 | Pelletier | 428/198 |

FOREIGN PATENT DOCUMENTS

| | | | |
|---|---|---|---|
| 485,106 | 4/1955 | Italy | 428/257 |

*Primary Examiner*—James C. Cannon
*Attorney, Agent, or Firm*—Townsend and Townsend

[57] ABSTRACT

A surface covering comprised of a base fabric having an adhesive layer thereon. First and second groups of fabric strips disposed on the adhesive layer in criss-crossed, interwoven relationship to each other. Each strip of each group has a plurality of spaced first segments bonded to the adhesive layer and a second segment between each pair of first segments, respectively, the second segments overlying a first segment of the adjacent strip of the other group. The widths of some of the strips differ from the widths of other strips. The color and patterns of these strips can differ from each other.

8 Claims, 4 Drawing Figures

FIG. 1
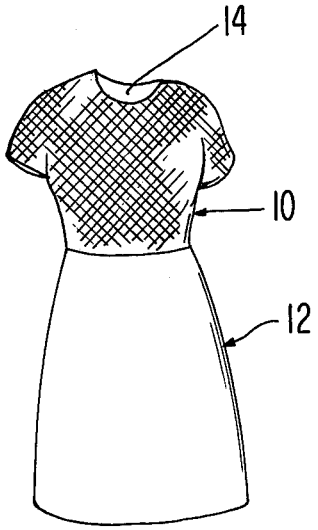
FIG. 2
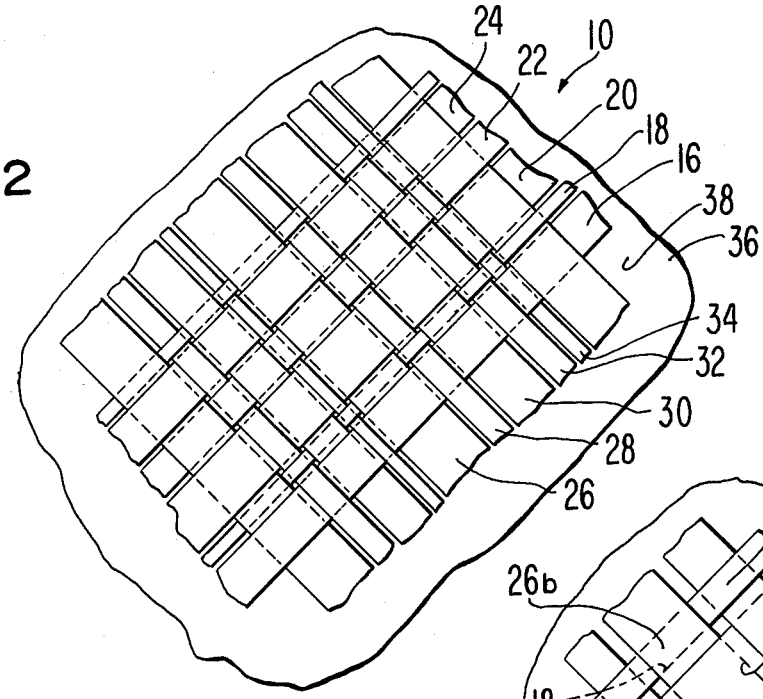
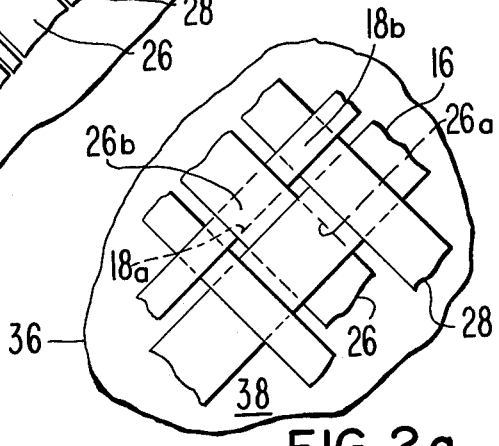
FIG. 2a
FIG. 3
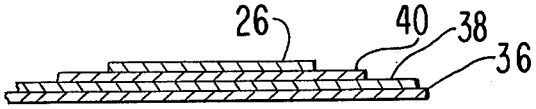

SURFACE COVERING WITH INTERWOVEN FABRIC STRIPS

This invention relates to improvements in cloth materials for use in covering surfaces and, more particularly, to a surface covering using criss-crossed interwoven strips which can be of different colors and patterns.

BACKGROUND OF THE INVENTION

Surface coverings, such as rugs, mats, wall covers and the like, have been made with strips which are criss-crossed and interwoven relative to each other. However, these prior art devices or surface coverings have been made either of relatively heavyweight strip material or, if made of fabric, are cemented or stitched so that the strips are stretched tightly and segments of the strips have no tendency to move relative to adjacent strips in a direction perpendicular to the faces of the strips. Typical of surface coverings of this type are those disclosed in the following U.S. Pat. Nos. 942,019; 1,227,520; 1,501,156; 1,928,356; 2,573,773; 3,551,267; 3,698,980; and 3,715,264.

Because of the foregoing limitations, the surface coverings of the above patents are not suitable for use in garments, bed coverings, drapes and the like to provide an aesthetic effect and a visual appearance which is pleasing to the casual observer yet functional to overlie or cover a surface. A need for such a surface covering, therefore, exists.

SUMMARY OF THE INVENTION

The present invention satisfies the aforesaid need by providing a surface covering comprised of a plurality of flat, criss-crossed, interwoven fabric strips which are arranged and coupled to a base in a manner to provide the appearance of a quilted exterior to an observer spaced from the surface covering itself. To this end, the invention utilizes a base of a suitable fabric having a layer of adhesive thereon and provided with first and second groups of strips, the strips of each group being in parallel, side-by-side relationship to each other and the first group of strips being substantially perpendicular to the second group of strips. In all cases, each strip of the first and second groups has a plurality of first segments which are spaced apart and which are in engagement with and are adhesively bonded to the base.

Each strip further includes a second segment between each pair of first segments, respectively, and the second segments of each strip of each group overlies first segments of adjacent strips of the other group. These second segments are, in effect, unattached to any adjacent strips or the base; thus, the second segments can move relative to and, in effect, bow outwardly of the corresponding first segments adjacent thereto. This tendency to bow provides a quilted appearance for the outer surface of the surface covering and this quilted appearance can change if one or more parts of the surface covering itself moves relative to other parts. Thus, if the surface covering is worn as the upper part of a garment, movement of the body will cause the shoulder parts to move relative to the waist parts, causing the quilted appearance to change continuously and thereby provide an artistic, pleasing appearance of immediate interest to an observer spaced from the surface covering.

The quilted appearance or effect is achieved by making some of the strips of widths different from the widths of other strips. This is believed to be due to the difference in weights of the strips, causing them to droop or to bow outwardly relative to other adjacent strips. When this occurs, the quilted appearance is presented much to the amazement and interest to casual observers of the surface covering.

The primary object of this invention is, therefore, to provide a surface covering having interwoven, criss-crossed strips arranged on a base in a manner to permit the surface covering to have a quilted appearance when in use to thereby provide an aesthetic appearance for the surface covering and one which is suitable for a number of different uses.

Another object of the present invention is to provide a surface covering of the type described, wherein each of the strips of first and second groups of strips has a plurality of spaced first segments bonded to an adhesive layer on the base and a second segment between each pair of first segments, respectively, the second segments being unattached so as to be able to bow outwardly and to provide the quilted effect which gives the aesthetic appearance to the surface covering.

Other objects of this invention will become apparent as the following specification progresses, reference being had to the accompanying drawings for an illustration of the invention.

IN THE DRAWING

FIG. 1 is a side elevational view of a garment having the surface covering of the present invention forming a part thereof;

FIG. 2 is an enlarged, fragmentary, side elevational view of the surface covering;

FIG. 2*a* is a view similar to FIG. 2 but on an enlarged scale; and

FIG. 3 is a fragmentary, cross-sectional view of the surface covering.

The surface covering of the present invention is broadly denoted by the numeral 10 and, for purposes of illustration, is described with respect to a garment 12 in the form of a woman's dress. Surface covering 10 is located above the waist portion of garment 12 and covers the front, sides, back, shoulders and parts of the upper arms of a person wearing the garment. A neck opening 14 is provided in surface covering 10.

Surface covering 10 includes first and second groups of flat fabric strips. The first group includes a plurality of first strips, some of which are denoted by numerals 16, 18, 20, 22 and 24 in FIG. 2. These first strips are arranged in parallel, side-by-side relationship The second group includes a plurality of second strips, some of which are denoted by the numerals 26, 28, 30, 32 and 34 in FIG. 2. The second strips also are in parallel, side-by-side relationship to each other. Furhtermore, they extend perpendicular to the first strips.

Surface covering 10 further includes a base 36 on which the first and second groups of strips are disposed, the strips defining the outer part of surface covering 10 and base 36 defining the inner part. The upper surface 38 (FIG. 2) of base 36 is provided with an adhesive of some suitable type. For purposes of illustration, base 36 can be of a commercially available fabric known as Stitch-Witchery which is sold by numerous cloth merchandisers and is provided with its own adhesive layer in a dried condition. By application of heat, the adhesive is made flowable and operates to bond other fabrics or materials to surface 38.

The first and second strips are interwoven with respect to each other so that each of the first and second strips has a plurality of first segments in contact with surface 38 of base 36 and a plurality of spaced second segments overlying first segments of adjacent strips. For instance, as shown in FIG. 2*a*, strip 18 has a first segment 18*a* denoted by dashed lines and a second segment 18*b* immediately adjacent to first segment 18*a*. Segment 18*a* underlies strip 26 but segment 18*b* overlies strip 28. The remaining part of strip 18 has alternating first and second segments, each first segment being in contact with surface 38 of base 36 and each second segment overlying a first segment of a strip of the other group as shown in FIG. 2*a*.

By the same token, strip 26 has a first segment 26*a* denoted by the dashed lines in FIG. 2*a* and in contact with surface 38, and a second segment 26*b* overlying first segment 18*a* of strip 18. In all cases, the strips are interwoven as shown in FIG. 2*a* throughout the entire extent of surface covering 10.

The strips can be of different colors and patterns. They can also be of different weight consistencies. Certain of the strips are of different widths from other strips and this feature provides an unexpected result, namely, that the second segments of the various strips, due to this difference in widths, have a tendency to bow outwardly to provide a quilted effect to a person viewing surface covering 10 from a distance. This is an effect not achieved by any surface covering of the prior art. For instance, strip 18 has a width less than strip 16 and strip 24 has a width greater than strip 22. Strip 26 has a width greater than strip 28 and strip 34 has a width less than strip 32. While it is true two adjacent strips can have the same width, FIG. 2 merely illustrates that adjacent strips are of different widths.

This difference in width also adds another feature to the present invention, namely, that the bowing of the various second segments of the strips changes due to shifting of the various parts of the garment. For instance, the person wearing garment 12, when walking, will shift various parts of the anatomy, such as the shoulders. When this occurs, the quilted effect caused by the bowing of the second segments of the various strips changes. Some second segments bow outwardly and then are pulled inwardly, then bow outwardly again, all due to the change in or displacement of the surface covering during movement of the body. The end result is to provide a visual effect of a quilted covering and not merely a series of stationary criss-crossed strips which one might otherwise expect. The surface covering of the present invention is not limited to use as part of a garment. It can be used for a covering for a bed, drapes, and the like.

To form surface covering 10, base 36 is provided with adhesive layer 40 on surface 38 thereof, following which the first and second strips are placed on base 36 and interwoven with respect to each other. After the strips have been interwoven and placed on surface 38 of base 36, a source of heat, such as a heated iron, is moved across the strips and the heat from the source causes a melting of adhesive layer 40 which adheres to the first segments of the first and second strips. After cooling, the adhesive strip layer solidifies and the first segments are then bonded to surface 38. The surface covering can be made in elongated strips and then cut to form the desired shape, such as the blouse part of garment 12 as shown in FIG. 1.

Base 36 can have adhesive layers added thereto before the application of the strips on the same. Thus, the base need not be formed of Stitch-Witchery as described above but can be of any suitable combination of base fabric and adhesive so long as the first segments of the first and second strips are bonded or otherwise secured to the base.

I claim:

1. In a surface covering: a backing sheet forming a base; a plurality of first, flat fabric strips extending along one face of the backing sheet and being in substantially parallel, side-by-side relationship to each other; a number of second flat, side-by-side fabric strips substantially perpendicular to the first strips and interwoven therewith, each of the first and second strips having spaced, first segments contiguous to the base and spaced, second segments in overlying relationship to the first segments of adjacent strips; and means on said one face of said base for bonding said first segments thereto, the widths of certain of the strips being different from the widths of other strips, and the strips being sufficiently flexible to permit the second segments of at least some of the strips to bow outwardly of the adjacent first segments to provide a quilted appearance for the covering when the same covers a surface.

2. In a surface covering as set forth in claim 1, wherein one group of said strips are formed from a first fabric material and the remaining strips being formed from a second fabric material.

3. In a surface covering as set forth in claim 1, wherein said bonding means comprises a layer of adhesive on at least a major portion of said one face of the base.

4. In a surface covering as set forth in claim 1, wherein said bonding means includes a group of spaced adhesive layers on said one face of said base.

5. In a surface covering as set forth in claim 1, wherein the base is adapted to present at least a part of a garment, said first and second strips being inclined when said backing sheet forms said garment part.

6. In a surface covering as set forth in claim 1, wherein certain of the strips have colors and color patterns different from those of other strips.

7. In a surface covering as set forth in claim 1, wherein said backing sheet is a fabric provided with an adhesive layer in a dried condition.

8. In a surface covering as set forth in claim 1, wherein the widths of said strips are in the range of $\frac{3}{8}$-inch to $1\frac{1}{2}$ inches.

* * * * *